United States Patent [19]

Korenko

[11] 4,225,363

[45] Sep. 30, 1980

[54] METHOD FOR HEAT TREATING IRON-NICKEL-CHROMIUM ALLOY

[75] Inventor: Michael K. Korenko, Richland, Wash.

[73] Assignee: The United States of America as represented by the United States Department of Energy, Washington, D.C.

[21] Appl. No.: 917,835

[22] Filed: Jun. 22, 1978

[51] Int. Cl.[2] ..... C21D 7/14; C22D 1/10

[52] U.S. Cl. ..... 148/12.7 N; 75/122; 75/134 F; 148/12.7 R

[58] Field of Search ..... 75/171, 134 F, 122; 148/12.7 N, 12.7 R, 12 E, 12 R, 11.5 N, 12.3

[56] References Cited

U.S. PATENT DOCUMENTS

| | | | |
|---|---|---|---|
| 3,046,108 | 7/1962 | Eiselstein | 75/171 |
| 4,066,447 | 1/1978 | Smith, Jr. et al. | 75/171 |

OTHER PUBLICATIONS

Cozar et al., "Morphology of Y' and Y" Precipitates and Thermal Stability of Momel 718 Type Alloys," Met. Trans., vol. 4, 1/73, pp. 47-59.

Huntington Alloys, "Inconel Alloy 206," Fat'l. Nickel Co., Inc., 1974, pp. 1-12.

*Primary Examiner*—Arthur J. Steiner

*Attorney, Agent, or Firm*—R. V. Lupo; Richard E. Constant; R. T. Randig

[57] ABSTRACT

A method for heat treating an age-hardenable iron-nickel-chromium alloy to obtain a morphology of the gamma-double prime phase enveloping the gamma-prime phase, the alloy consisting essentially of about 40 to 50% nickel, 7.5 to 14% chromium, 1.5 to 4% niobium, 0.3 to 0.75% silicon, 1 to 3% titanium, 0.1 to 0.5% aluminum, 0.02 to 1% carbon, 0.002 to 0.0015% boron and the remain substantially all iron. To obtain optimal results, the alloy is cold-worked 20 to 60% followed by heating at 1050° C. for ½ hour with an air-cool plus heating at 800° C. for 2 hours with a furnace cool to 625° C. The alloy is then held at 625° C. for 12 hours, followed by an air-cool.

5 Claims, 3 Drawing Figures

METHOD FOR HEAT TREATING IRON-NICKEL-CHROMIUM ALLOY

GOVERNMENT CONTRACT

This invention was conceived during the performance of work under Contract EY-76-C-14-2170 for the Department of Energy.

BACKGROUND OF THE INVENTION

In copending application Ser. No. 917,832, filed concurrently herewith, there is described a nickel-chromium-iron alloy which has strong mechanical properties and, at the same time, has swelling resistance under the influence of irradiation and low neutron absorbence. As such, it is particularly adapted for use as a duct and cladding alloy for fast breeder reactors.

By reference to the aforesaid copending application Ser. No. 917,832, it will be seen that the high strength of the alloy at high temperatures is due to a morphology of the gamma-double prime phase enveloping the gamma-prime phase and in which any delta phase is distributed at or near the grain boundaries. While aging, the alloy described therein will precipitate as three different phases, namely a high temperature delta phase which tends to nucleate and grow at or near the grain boundaries, the gamma-prime spheroidal strengthening phase, and the gamma-double prime platelet strengthening phase. It is desirable, in order to obtain best mechanical properties, to precipitate only the gamma-prime and gamma-double prime phases with the delta phase, in or near the grain boundaries.

SUMMARY OF THE INVENTION

In accordance with the present invention, an alloy of the compositional ranges given about is initially cold-worked 20 to 60% followed by heating in the range of 1000° C. to 1100° C. for up to 1 hour with an air-cool, plus heating at 750° C. to 850° C. for 1.5 to 2.5 hours. Additional improvement in strength can be derived by an anneal at 600° C. to 650° C. for about 12 hours, followed by an air-cool.

The above and other objects and features of the invention will become apparent from the following detailed description taken in connection with the accompanying drawings which form a part of this specification, and in which.

The alloys heat treated in accordance with the invention have the following broad and preferred ranges of composition:

TABLE I

| | Broad-% | Preferred-% |
|---|---|---|
| Nickel | 40–50 | 43–47 |
| Chromium | 7.5–14 | 8–12 |
| Niobium | 1.5–4 | 3–3.8 |
| Silicon | .25–.75 | .3–.4 |
| Zirconium | 0–.1 | 0–.05 |
| Titanium | 1–3 | 1.5–2 |
| Aluminum | .1–.5 | .2–.3 |
| Carbon | .02–.1 | .02–.05 |

TABLE I-continued

| | Broad-% | Preferred-% |
|---|---|---|
| Boron | .002–.015 | .002–.006 |
| Molybdenum | 0–2 | 0–3 |
| Iron | Bal | Bal |

In addition, small amounts of manganese and magnesium may be added to reduce grain boundary effects. The nominal composition of the alloy is 45% nickel, 12% chromium, 3.6% niobium, 0.35% silicon, 0.2% manganese, 0.01% magnesium, 0.05% zirconium, 1.7% titanium, 0.3% aluminum, 0.03% carbon, 0.005% boron and the remainder substantially all iron.

Figure 1:
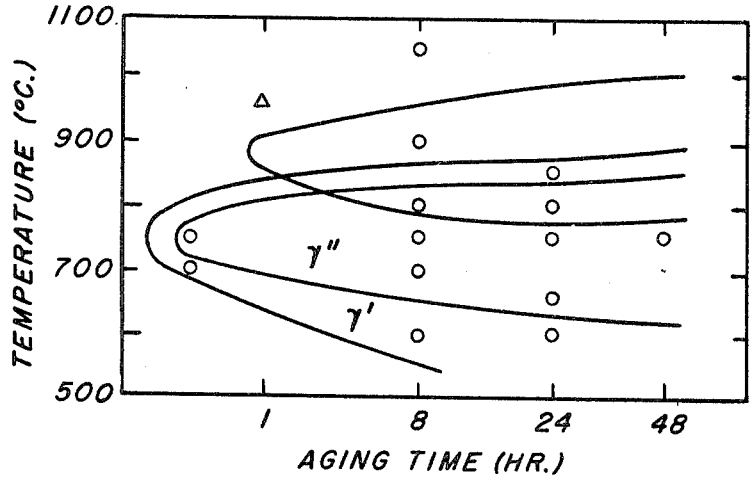
FIG. 1 is a structural map of the alloy described above heat treated in accordance with the invention as a function of aging time and temperature.

In order to formulate the optimal heat treatment of the invention, a number of transmission electron microscopy specimens in the compositional ranges set forth above were heat treated to identify the resulting phases and their aging characteristics. The results are shown in FIG. 1. Three strengthening phases were identified. The first is a high temperature delta phase (δ) which tended to nucleate and grow in grain boundaries. The second is the gamma-prime (Y′) spheroidal strengthening phase, and the third is the gamma-double prime (Y″) platelet strengthening phase. The black dots in FIG. 1 represent a specimen examination at the indicated temperature and time of age. The precipitation kinetics of the three phases are represented in the form of C-curves. It will be noted that the delta phase precipitates at high temperatures, above 775° C.; while the gamma-prime and gamma-double prime phases precipitate almost simultaneously at lower temperatures, in the range of about 500° C. to 850° C. It is possible to produce only delta phase precipitation by aging at 900° C., or to produce only gamma-prime and gamma-double prime by aging between 650° C. and 750° C., or to produce all of the phases by aging at about 800° C.

A solution anneal of 1050° C. is sufficiently high to place all secondary phases into solution. As shown in FIG. 1, the delta phase precipitates in the range of 775° C. to 975° C. Precipitation occurs by nucleating at the grain boundaries and growing into the grains. Delta phase is usually considered undesirable; however, as will be seen, a certain amount of the delta phase is preferred to obtain optimal results. It is for this reason that a heat treatment at 800° C. rather than 750° C., for example, was selected for best results. Photomicrographs show that at 800° C., the delta plates are nucleating at the grain boundaries and are surrounded by small spherical gamma-prime precipitates, with no gamma-double prime particles in the near vicinity. This gamma-double prime denuded zone is a result of the niobium-rich delta phase absorbing the niobium from the matrix, which prevents the formation of the niobium-rich gamma-double prime platelets. Further away from the grain boundaries, both gamma-prime and gamma-double prime phases coexist and in many cases are associated. At temperatures of 750° C. or lower, the gamma-prime phase nucleates first, followed very quickly by the gamma-double prime phase.

Figure 2:
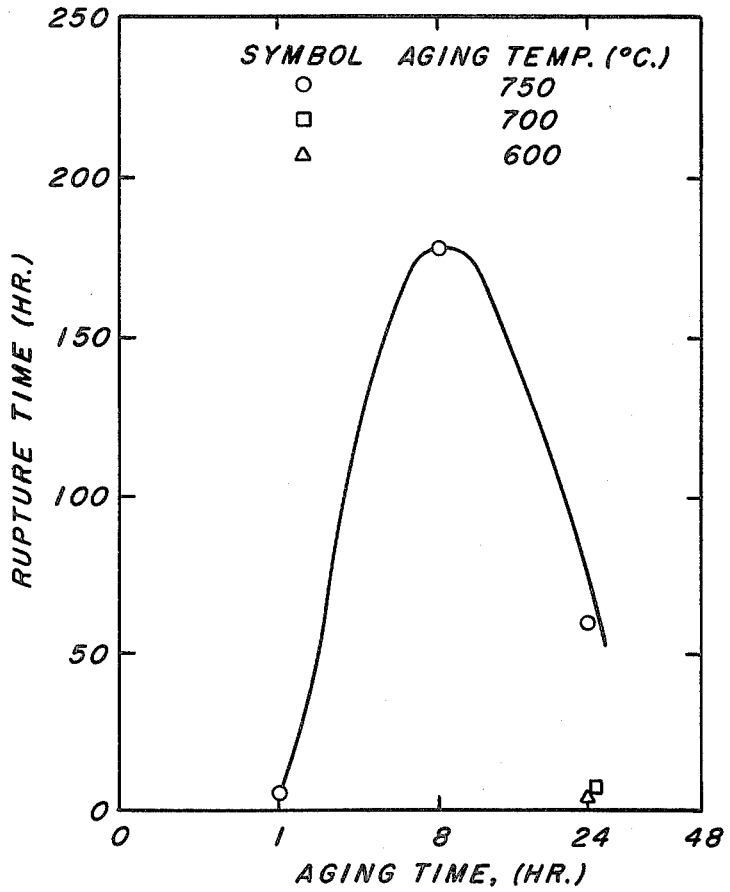
FIG. 2 is a plot of rupture time versus aging time of the alloy heat treated in accordance with the invention at 650° C. and at a testing stress of 621 MPa.

The results of heat treating the alloy of the invention at 750° C. are shown in FIG. 2. Note that a heat treatment at 750° C., illustrated by the full-line curve, gives much better results than heat treating at lower temperatures such as 700° C. or 600° C. This is for the reason that at these lower temperatures, the gamma-prime/-gamma-double prime structure has not aged sufficiently. Thus, a single lower temperature age by itself cannot produce the required strength. At an aging temperature of 750° C., the optimal aging time, as shown in FIG. 2, is eight hours. This produces a rupture time of about 175 hours at 650° C. and a testing stress of 621 MPa.

The data from which the plot of FIG. 2 was derived is shown in the following Table II where it can be seen that most specimens aged at 750° C. for 24 hours, for example, have much poorer stress rupture properties than the same alloy aged for eight hours at 750° C.

TABLE II

| Specimen Number | Aging Temperature (°C.) | Aging Time (hr) | Testing Stress (MPa) | Time to Rupture (hr)** |
|---|---|---|---|---|
| 6801 | 750 | 1 | 621 | 1.3 |
| 6802 | 750 | 8 | 621 | 178.4 |
| 6803 | 750 | 24 | 758 | 0.9 |
| 6804 | 750 | 24 | 586 | 207.6 |
| 6805 | 600 | 24 | 621 | 1.0 |
| 6808 | 700 | 24 | 621 | 1.1 |
| 6810 | 775 | 24 | 621 | 47.5 |
| 6811 | 800 | 24 | 621 | 53.0 |
| 6813 | 800 | 2 | 621 | 279.9 |
| | + FC to 625 | 12* | | |
| 6814 | 800 | 2 | 724 | 2.9 |
| | + FC to 625 | 12* | | |
| 6815 | 750 | 2 | 621 | 2.3 |
| | + FC to 625 | 12* | | |

*Additional hours.
**At 650° C.

Specimen No. 6810 was aged at 775° C. for 24 hours. It will be noted that at a testing stress of 621 MPa, the time to rupture is considerably increased over the case where the temperature is 750° C. for the same aging time of 24 hours. Specimen No. 6811 was aged at 800° C. for 24 hours and tested under the same conditions as Specimen No. 6810. Note that the increase in temperature to 800° C. at an aging time of 24 hours materially increases the time to rupture from 47.5 hours to 53.0 hours.

Specimen No. 6813 was aged at 800° C. for two hours followed by a furnace cool to 625° C. where it was held for 12 hours. This produces the optimum stress rupture properties of 279.9 hours to rupture at 650° C. and 621 MPa testing stress. At a testing stress of 724 MPa (Specimen No. 6814), the time to rupture is 2.9 hours. However, in the case of Specimen No. 6815 which had the same heat treatment as Specimen No. 6813 except that the aging temperature was 750° C. rather than 800° C., the time to rupture drops from 279.9 hours to 2.3 hours at 650° C. and 621 MPa.

Figure 3:
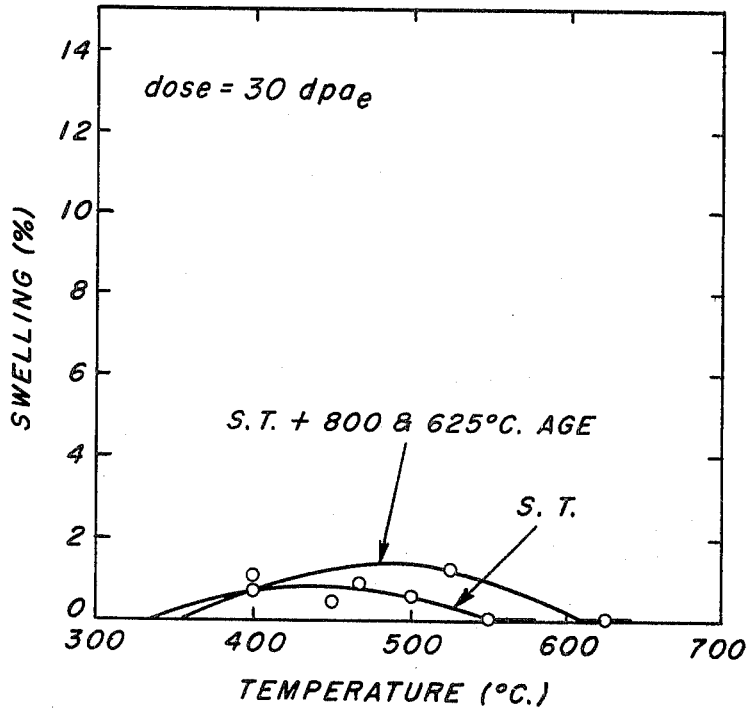
FIG. 3 is a plot of percent swelling versus temperature.

Not only does the heat treatment of the invention produce optimum high temperature mechanical properties, it also results in a material which is extremely swelling resistant in response to irradiation. This is shown in FIG. 3 where percent swelling is plotted against temperature at a radiation dose of 30 $dpa_e$. The lower curve 10 represents the swelling resistance for the alloy of the invention which is solution treated only at about 1050° C. for ½ hour. The upper curve 12 represents percent swelling for the solution treated alloy which was aged at 800° C. for two hours followed by furnace cooling at 625° C. for 12 hours. It will be noted that both the solution treated and solution treated plus aged conditions are extremely swelling resistant. Thus, the alloy described above, heat treated in accordance with the method of the invention, is both strong and swelling resistant. It will be appreciated that while aging at 800° C. for 2 hours is the optimum condition, improved results can also be achieved by heating somewhere in the range of 750° C. to 850° C. for 1.5 to 2.5 hours with the understanding that the properties of the alloy at the upper and lower ends of the ranges will not be optimum.

Although the invention has been described in connection with certain specific embodiments, it will be readily apparent to those skilled in the art that various changes in form and arrangement of parts may be made to suit requirements without departing from the spirit and scope of the invention.

What is claimed is:

1. A method for heat treating an age-hardenable iron-nickel-chromium alloy consisting essentially of about 40 to 50% nickel, 7.5 to 14% chromium, 1.5 to 4% niobium, 0.3 to 0.75% silicon, 1 to 3% titanium, 0.1 to 0.5% aluminum, 0.02 to 1% carbon, 0.002 to 0.0015% boron and the remainder substantially all iron, which method comprises the steps of cold-working the alloy 20 to 60% followed by heating in the range of 1000° C. to 1100° C. for up to 1 hour with an air-cool, and thereafter heating the alloy in the range of 750° C. to 850° C. for 1.5 to 2.5 hours.

2. The method of claim 1 including the step of finally annealing the alloy in the range of 600° C. to 650° C. for about 12 hours, followed by an air-cool.

3. A method for heat treating an age-hardenable iron-nickel-chromium alloy consisting essentially of about 40 to 50% nickel, 7.5 to 14% chromium, 1.5 to 4% niboium, 0.3 to 0.75% silicon, 1 to 3% titanium, 0.1 to 0.5% aluminum, 0.02 to 1% carbon, 0.002 to 0.0015% boron and the remainder substantially all iron, which method comprises the steps of cold-working the alloy 20 to 60%, thereafter solution annealing the alloy at a temperature of about 1050° C., thereafter aging the alloy at about 800° C. for about 2 hours with a furnace cool to about 625° C., and finally holding the alloy at about 625° C. for about 12 hours, followed by an air-cool.

4. The method of claim 3 wherein the alloy is solution annealed at 1050° C. for about ½ hour, followed by an air-cool.

5. A method for heat treating an age-hardenable iron-nickel-chromium alloy consisting essentially of about 45% nickel, about 12% chromium, about 3.6% niobium, about 0.35% silicon, about 1.7% titanium, about 0.3% aluminum, about 0.03% carbon and the remainder iron, which method comprises the steps of solution annealing said alloy in the range of about 1000° C. to 1100° C. after cold-working, heating the alloy at 800° C. for 2 hours with a furnace cool to 625° C., and thereafter holding the alloy at 625° C. for 12 hours, followed by an air-cool.

* * * * *